US011697946B2

(12) United States Patent
Morrow

(10) Patent No.: US 11,697,946 B2
(45) **Date of Patent: *Jul. 11, 2023**

(54) POOL OR OTHER BELOW GRADE FLUID CONTAINMENT

(71) Applicant: BLUE TOMATO, LLC, Provo, UT (US)

(72) Inventor: Brian D. Morrow, Provo, UT (US)

(73) Assignee: Blue Tomato, LLC, Provo, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/465,666

(22) Filed: Sep. 2, 2021

(65) Prior Publication Data

US 2023/0009162 A1 Jan. 12, 2023

Related U.S. Application Data

(63) Continuation-in-part of application No. 16/653,579, filed on Oct. 15, 2019, now Pat. No. 11,401,724.

(60) Provisional application No. 62/746,118, filed on Oct. 16, 2018.

(51) Int. Cl.
*E04H 4/14* (2006.01)
*E04H 4/00* (2006.01)

(52) U.S. Cl.
CPC ..... *E04H 4/14* (2013.01); *E04H 4/0075* (2013.01)

(58) Field of Classification Search
CPC ..... E04H 4/14
USPC ..... 4/488, 506–513
See application file for complete search history.

(56) References Cited

U.S. PATENT DOCUMENTS

| | | | |
|---|---|---|---|
| 2,202,783 | A | 5/1940 | Morrell |
| 2,321,567 | A | 6/1943 | Wilson |
| 2,844,848 | A | 7/1958 | Couse et al. |
| 3,236,014 | A | 2/1966 | Norman |
| 3,284,980 | A | 11/1966 | Dinkel |
| 3,310,917 | A | 3/1967 | Simon |

(Continued)

FOREIGN PATENT DOCUMENTS

| | | | |
|---|---|---|---|
| DE | 3034601 | A1 | 4/1982 |
| FR | 2359942 | A1 | 2/1978 |

(Continued)

OTHER PUBLICATIONS

Ex Parte Quayle Action received for U.S. Appl. No. 29/648,685, dated Feb. 15, 2019.

(Continued)

*Primary Examiner* — Lori L Baker
(74) *Attorney, Agent, or Firm* — Workman Nydegger

(57) ABSTRACT

Below grade fluid containment structures, which may include a foam floor and a foam wall extending upward from the floor, the foam wall being formed from foam panels and optionally a plurality of metal splines. A foam buttress is provided as part of or adjacent to the foam wall, for reducing pressure against an exterior face of the foam wall that would otherwise be exerted by the soil, in the absence of the foam buttress, which places a top portion of the soil at an angle of repose, to minimize inward pressure. A concrete footing can be provided below the foam wall, where the splines of the wall are vertically oriented in the foam wall, with a bottom of the splines anchored into the concrete footing. The interior surface of the pool or other structure can be coated with any desired finish coating.

20 Claims, 5 Drawing Sheets

(56) References Cited

U.S. PATENT DOCUMENTS

| | | | |
|---|---|---|---|
| 3,353,315 | A | 11/1967 | Barker |
| 3,374,703 | A | 3/1968 | Davis et al. |
| 3,517,468 | A | 6/1970 | Thomas |
| 3,529,390 | A | 9/1970 | Stetter |
| 3,646,715 | A | 3/1972 | Pope |
| 3,699,731 | A | 10/1972 | Arnold |
| 3,775,916 | A | 12/1973 | Bair |
| 3,808,085 | A | 4/1974 | Givens |
| 3,888,055 | A | 6/1975 | Gallo |
| 4,035,972 | A | 7/1977 | Timmons |
| 4,435,928 | A | 3/1984 | Huling |
| 4,443,988 | A | 4/1984 | Coutu, Sr. |
| 4,578,909 | A | 4/1986 | Henley et al. |
| 4,578,915 | A | 4/1986 | Schneller |
| 4,615,448 | A | 10/1986 | Johnstonbaugh |
| 4,617,219 | A | 10/1986 | Schupack |
| 4,641,468 | A | 2/1987 | Slater |
| 4,774,794 | A | 10/1988 | Grieb |
| 4,893,451 | A | 1/1990 | Valente |
| 4,944,416 | A | 7/1990 | Petersen et al. |
| 5,003,742 | A | 4/1991 | Dettbarn |
| 5,030,502 | A | 7/1991 | Teare |
| 5,062,387 | A | 11/1991 | Anderson |
| 5,121,578 | A | 6/1992 | Holz |
| 5,138,803 | A | 8/1992 | Grossen |
| 5,172,532 | A | 12/1992 | Gibbar, Jr. |
| 5,173,233 | A | 12/1992 | Kafarowski |
| 5,181,353 | A | 1/1993 | Harrington |
| 5,231,813 | A | 8/1993 | Drawdy |
| 5,268,226 | A | 12/1993 | Sweeney |
| 5,353,560 | A | 10/1994 | Heydon |
| 5,353,562 | A | 10/1994 | Decker |
| 5,377,470 | A | 1/1995 | Hebinck |
| 5,390,462 | A | 2/1995 | Kreiter |
| 5,403,062 | A | 4/1995 | Sjostedt et al. |
| D384,108 | S | 9/1997 | Rinicella et al. |
| 5,694,730 | A | 12/1997 | Del et al. |
| 5,803,964 | A | 9/1998 | Scarborough |
| 5,822,940 | A | 10/1998 | Carlin et al. |
| 5,899,037 | A | 5/1999 | Josey |
| 5,901,522 | A | 5/1999 | Slater |
| 5,921,046 | A | 7/1999 | Hammond, Jr. |
| 5,927,032 | A | 7/1999 | Record |
| 5,950,389 | A | 9/1999 | Porter |
| D444,577 | S | 7/2001 | Neuhofer, Jr. |
| 6,305,135 | B1 | 10/2001 | Inaba |
| 6,324,809 | B1 | 12/2001 | Nelson |
| 6,460,302 | B1 | 10/2002 | Neuhaus et al. |
| 6,470,632 | B1 | 10/2002 | Smith |
| 6,481,172 | B1 | 11/2002 | Porter |
| 6,571,523 | B2 | 6/2003 | Chambers |
| D477,423 | S | 7/2003 | Campbell et al. |
| 6,701,683 | B2 | 3/2004 | Messenger et al. |
| 6,772,890 | B2 | 8/2004 | Campbell et al. |
| 6,985,832 | B2 | 1/2006 | Saebi |
| 7,028,440 | B2 | 4/2006 | Brisson |
| 7,036,196 | B2 | 5/2006 | Salatin et al. |
| 7,093,726 | B1 | 8/2006 | William |
| 7,165,374 | B2 | 1/2007 | Ohanesian |
| 7,712,265 | B2 * | 5/2010 | Overmyer, Jr. ..... E04B 1/161 52/309.7 |
| 7,779,600 | B1 | 8/2010 | Saebi |
| 7,913,730 | B2 | 3/2011 | Schaffeld |
| 8,151,539 | B2 | 4/2012 | Grinsted |
| 8,220,648 | B2 | 7/2012 | Barkdoll et al. |
| 8,468,767 | B1 | 6/2013 | Mcbride |
| 8,627,625 | B2 | 1/2014 | Bouchard et al. |
| 8,695,299 | B2 | 4/2014 | Propst |
| 9,234,355 | B2 | 1/2016 | Sealock et al. |
| D861,194 | S | 9/2019 | Morrow |
| 10,450,736 | B2 | 10/2019 | Morrow |
| 10,865,560 | B1 | 12/2020 | Morrow |
| 11,401,724 | B2 * | 8/2022 | Morrow ..... E02D 29/045 |
| 2005/0284060 | A1 | 12/2005 | Ritchie |
| 2006/0046068 | A1 | 3/2006 | Barancyk et al. |
| 2006/0207479 | A1 | 9/2006 | Hughes |
| 2007/0131308 | A1 | 6/2007 | Martin |
| 2008/0282632 | A1 | 11/2008 | Sleeman |
| 2009/0100780 | A1 | 4/2009 | Mathis et al. |
| 2009/0205277 | A1 | 8/2009 | Gibson |
| 2010/0011699 | A1 | 1/2010 | Weimer et al. |
| 2010/0083590 | A1 | 4/2010 | Wochnik |
| 2010/0095625 | A1 | 4/2010 | Boutaghou et al. |
| 2010/0136269 | A1 | 6/2010 | Andersen et al. |
| 2011/0067331 | A1 | 3/2011 | Grinsted |
| 2011/0173911 | A1 | 7/2011 | Propst |
| 2011/0214374 | A1 | 9/2011 | Propst |
| 2012/0011793 | A1 | 1/2012 | Clark et al. |
| 2013/0008129 | A1 | 1/2013 | Hall |
| 2013/0086850 | A1 | 4/2013 | Morrow |
| 2013/0216760 | A1 | 8/2013 | Bol |
| 2013/0227902 | A1 | 9/2013 | Van et al. |
| 2013/0266370 | A1 | 10/2013 | Gunther |
| 2014/0250827 | A1 | 9/2014 | Gillman |
| 2015/0135634 | A1 | 5/2015 | Hoie et al. |
| 2016/0014995 | A1 | 1/2016 | Bruno |
| 2016/0208489 | A1 | 7/2016 | Gibson |
| 2017/0096825 | A1 | 4/2017 | Bree |
| 2017/0121958 | A1 | 5/2017 | Jin |
| 2017/0211268 | A1 | 7/2017 | Eichhorn et al. |
| 2018/0298600 | A1 | 10/2018 | Moss et al. |
| 2019/0242109 | A1 | 8/2019 | Morrow |
| 2020/0001583 | A1 | 1/2020 | Eichhorn et al. |
| 2020/0354945 | A1 | 11/2020 | Morrow |
| 2021/0040722 | A1 | 2/2021 | Morrow |
| 2021/0040733 | A1 | 2/2021 | Morrow |
| 2021/0040759 | A1 | 2/2021 | Morrow |
| 2021/0301528 | A1 | 9/2021 | Dombowsky et al. |

FOREIGN PATENT DOCUMENTS

| | | | |
|---|---|---|---|
| GB | 2261234 | A | 5/1993 |
| JP | 07-102680 | A | 4/1995 |
| JP | 10-148095 | A | 6/1998 |
| JP | 2002-292612 | A | 10/2002 |
| KR | 10-1993-0010328 | A | 6/1993 |
| KR | 10-2009-0065909 | A | 6/2009 |
| WO | 2013/052427 | A2 | 4/2013 |
| WO | 2018/194528 | A1 | 10/2018 |
| WO | 2021/118744 | | 6/2021 |

OTHER PUBLICATIONS

Final Office Action received for U.S. Appl. No. 13/436,403, dated Aug. 1, 2013.

Final Office Action received for U.S. Appl. No. 16/549,901, dated Mar. 12, 2021, 6 pages.

International Search Report for PCT/US2012/058344 dated Mar. 28, 2013, 3 pages.

Non-Final Office Action received for U.S. Appl. No. 16/549,901, dated Sep. 4, 2020.

Non-Final Office Action received for U.S. Appl. No. 16/824,209, dated Jul. 29, 2021, 13 pages.

Notice of Allowance received for U.S. Appl. No. 13/866,569, dated Jun. 20, 2014.

Notice of Allowance received for U.S. Appl. No. 16/549,901, dated Apr. 16, 2021, 8 pages.

Notice of Allowance received for U.S. Appl. No. 16/942,166, dated Nov. 23, 2021, 8 pages.

Notice of Allowance received for U.S. Appl. No. 29/648,685, dated May 9, 2019.

Office Action received for U.S. Appl. No. 13/436,403, dated Feb. 13, 2013.

Office Action received for U.S. Appl. No. 15/426,756, dated Feb. 23, 2018.

Office Action received for U.S. Appl. No. 15/987,366, dated Feb. 14, 2019.

Office Action received for U.S. Appl. No. 16/709,674, dated Apr. 6, 2020.

U.S. Application filed on Apr. 19, 2013 by Morrow., U.S. Appl. No. 13/866,569.

(56) References Cited

OTHER PUBLICATIONS

U.S. Application filed on Aug. 23, 2019. by Morrow., U.S. Appl. No. 16/549,901.
U.S. Application filed on Feb. 7, 2017 by Morrow., U.S. Appl. No. 15/426,756.
U.S. Application filed on Jul. 31, 2018, by Morrow., U.S. Appl. No. 29/658,417.
U.S. Application filed on Mar. 19, 2020 by Morrow., U.S. Appl. No. 16/824,209.
U.S. Application filed on May 23, 2018, by Morrow., U.S. Appl. No. 29/648,685.
U.S. Appl. No. 13/436,403, filed Mar. 30, 2012.
U.S. Appl. No. 62/722,591, filed Aug. 24, 2018.
U.S. Appl. No. 62/890,818, filed Aug. 23, 2019.
U.S. Appl. No. 62/991,889, filed Mar. 19, 2020.
U.S. Appl. No. 16/942,166, filed Jul. 29, 2020.
U.S. Appl. No. 29/744,477, filed Jul. 29, 2020.
Notice of Allowance received for U.S. Appl. No. 16/824,209, dated Jan. 20, 2022, 8 pages.
Office Action received for U.S. Appl. No. 16/653,579, dated Feb. 25, 2022, 8 pages.

* cited by examiner

POOL OR OTHER BELOW GRADE FLUID CONTAINMENT

CROSS-REFERENCE TO RELATED APPLICATION

This application is a continuation-in-part under 35 U.S.C. 120 of U.S. application Ser. No. 16/653,579 filed Oct. 15, 2019 and entitled BELOW GRADE FLUID CONTAINMENT, which claims the benefit under 35 U.S.C. 119(e) of U.S. Provisional Application No. 62/746,118, filed Oct. 16, 2018, which is entitled BELOW GRADE FLUID CONTAINMENT, which is herein incorporated by reference in its entirety.

BACKGROUND OF THE INVENTION

1. The Field of the Invention

The present invention is in the field of construction methods and systems used in constructing swimming pools, as well as other below grade fluid containment structures, particularly with a modular construction system.

2. The Relevant Technology

Building construction systems including modular features are sometimes used in the construction field, although such systems rarely if ever are used in construction of swimming pools or other below grade fluid containment structures. For example, typically such structures are made out of precast concrete or constructed using rebar reinforcement, which is then covered over with shotcrete.

Existing construction systems and methods for constructing such below grade fluid containment structures continue to exhibit various drawbacks, at least some of which can be improved upon by the systems and methods disclosed herein.

SUMMARY

The present invention is directed to below grade fluid containment structures, such as swimming pools, septic tanks, biodigesters, or other below grade structures that may be filled with water or other liquid. One embodiment may include a foam floor, a foam wall extending upward from the floor, where the foam wall and/or foam floor are formed from foam panels. Such foam (e.g., expanded polystyrene) is lightweight, with a density of about 1 lb/ft$^3$ (e.g., from 1 to 10 lb/ft$^3$). The foam panels and any frame or spline structures may be such as those described in Applicant's U.S. patent or U.S. Pat. No. 10,450,736, D861,194, 62/890,818, Ser. No. 16/709,674 (now U.S. Pat. No. 10,865,560, 16/824,209, 62/991,889, Ser. No. 16/942,166, PCT/US20/59989, 29/744,477, and Ser. No. 16/549,901, each of which is incorporated herein by reference in its entirety. The containment structure may further include a granular material (e.g., gravel, crushed stone, or the like) for reducing hydraulic soil pressure against an exterior face of the foam wall. The granular material may be positioned on the exterior surface of the foam wall (i.e., on the outside thereof, against the wall), so as to be between the foam wall and soil (i.e., dirt) that defines the grade. An interior face of the foam wall is further coated with a polymeric, plaster, cement, or other desired coating. In an embodiment, the coating seals a below grade interior space defined between the floor and the wall in a seamless water-tight configuration.

In an embodiment, a pool or other below grade fluid containment structure may include a foam floor, a foam wall extending upward from the floor, where the foam wall is formed from a system of modular foam panels positioned between pairs of splines, and a concrete footing positioned below the foam wall, where the splines are vertically oriented in the foam wall, with a bottom of the splines anchored into the concrete footing. The foam panels may include a foam body (e.g., generally rectangular), and may include channels extending along a length or width (e.g., the height) of the panel. Each channel can be configured to receive at least a portion of a spline (e.g., a flange of the spline) in the channel. Each flange or other spline portion once received into the channel is positioned within the foam body, so that the flange and its spline are restrained once received in the corresponding channel. An interior face of the foam wall, as well as the foam floor can be coated with cement, plaster, or other coating (e.g., any desired pool or other structure coating or liner) to provide a desired finished interior surface for the pool or other below grade fluid containment structure.

Another embodiment may include a foam floor, a foam wall extending upwardly from the floor, where the foam wall is formed from a system of modular foam panels and a pair of metal splines, where each panel is positioned between a pair of metal splines on either side of the panel. Each such foam panel may include a foam body, and a pair of channels extending vertically along a height of the panel, with each channel being configured to receive a flange of a spline therein. Each flange once received in the channel is disposed within the foam body, so that the spline is restrained once received within the channel. A concrete footing is provided below the foam wall, wherein the splines are vertically oriented in the foam wall, with a bottom of the splines being anchored into the concrete footing. The foam wall includes a foam buttress positioned adjacent a top of the foam wall, extending laterally outward from the foam wall (and the pool or other structure). The foam buttress is shaped (e.g., generally triangular in cross-section) to reduce soil load by putting soil adjacent the foam wall at an angle that approximates (or is less than) an angle of repose for the soil. Such a buttress greatly reduces hydraulic pressure of the surrounding soil, against the pool or other structure wall. As noted above, an interior face of the foam wall and the foam floor can be coated with a desired coating or liner to provide any desired finished interior surface for the pool or other structure.

Individual features from any of the embodiments disclosed herein may be used in combination with one another, without limitation. In addition, these and other benefits and features of the present invention will become more fully apparent from the following description and appended claims or may be learned by the practice of the invention as set forth hereinafter.

BRIEF DESCRIPTION OF DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The drawings illustrate several embodiments of the invention, wherein identical reference numerals refer to identical or similar elements or features in different views or embodiments shown in the drawings.

DETAILED DESCRIPTION OF THE PREFERRED EMBODIMENTS

I. Definitions

Figure 1:
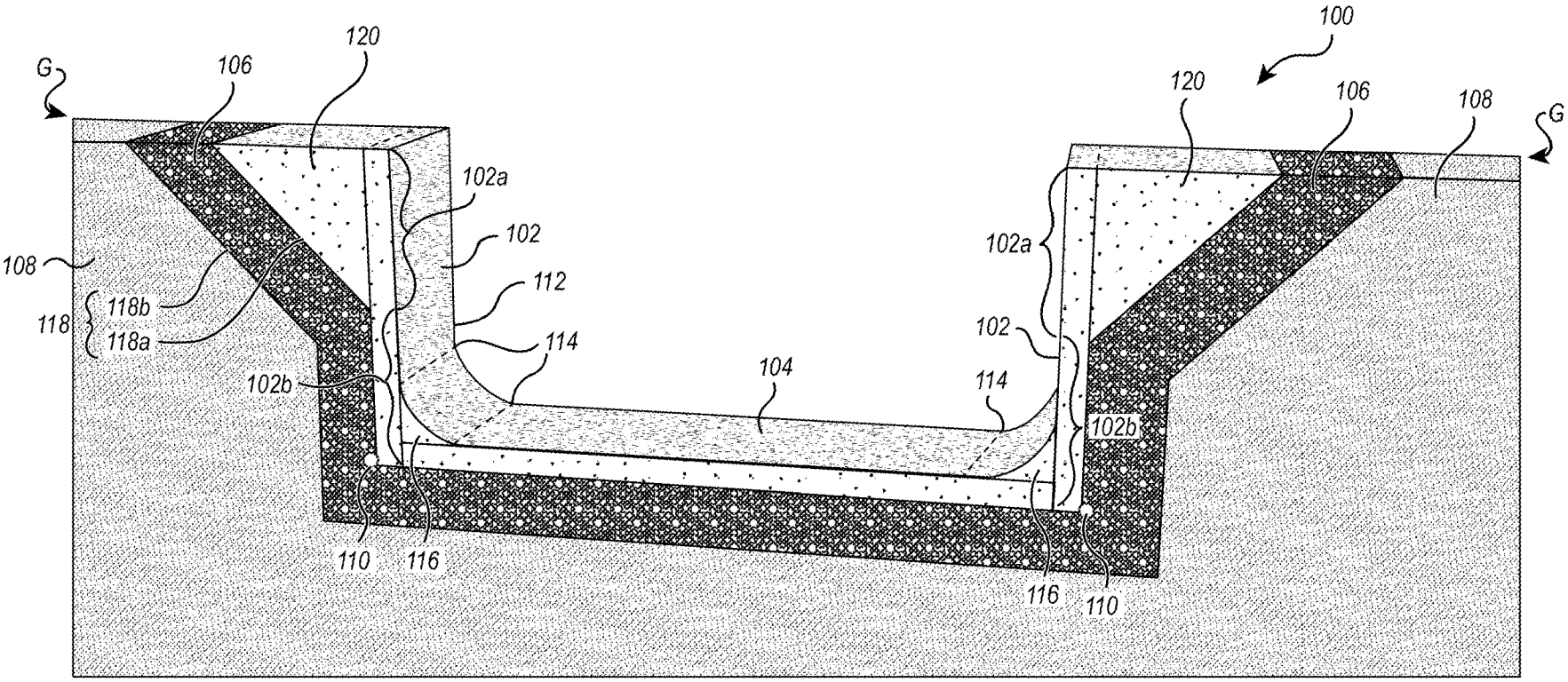
FIG. 1 illustrates a cross-section through an exemplary construction scheme for a below grade fluid containment structure according to the present invention.

All publications, patents and patent applications cited herein, whether supra or infra, are hereby incorporated by reference in their entirety to the same extent as if each individual publication, patent or patent application was specifically and individually indicated to be incorporated by reference.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise.

Numbers, percentages, ratios, or other values stated herein may include that value, and also other values that are about or approximately the stated value, as would be appreciated by one of ordinary skill in the art. As such, all values herein are understood to be modified by the term "about". A stated value should therefore be interpreted broadly enough to encompass values that are at least close enough to the stated value to perform a desired function or achieve a desired result, and/or values that round to the stated value. The stated values include at least the variation to be expected in a typical manufacturing process, and may include values that are within 10%, within 5%, within 1%, etc. of a stated value. Furthermore, where used, the terms "substantially", "similarly", "about" or "approximately" represent an amount or state close to the stated amount or state that still performs a desired function or achieves a desired result. For example, the term "substantially" "about" or "approximately" may refer to an amount that is within 10% of, within 5% of, or within 1% of, a stated amount or value.

Some ranges may be disclosed herein. Additional ranges may be defined between any values disclosed herein as being exemplary of a particular parameter. All such ranges are contemplated and within the scope of the present disclosure.

In some embodiments, the methods or articles described herein may be free or substantially free from any specific steps or components not mentioned within this specification.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

II. Introduction

In one embodiment, the present invention is directed to below grade fluid containment structures, such as swimming pools, septic tanks, biodigesters, or other below grade structures that may be filled with water or other liquid. One embodiment may include a foam floor, a foam wall extending upward from the floor, where the foam wall and/or foam floor are formed from foam panels. The foam panels and any splines, associated frames, etc., may be such as those described in Applicant's U.S. patent or U.S. Pat. No. 10,450,736, D861,194, 62/890,818, Ser. No. 16/709,674 (now U.S. Pat. No. 10,865,560, 16/824,209, 62/991,889, Ser. No. 16/942,166, PCT/US20/59989, 29/744,477, and Ser. No. 16/549,901, each of which is incorporated herein by reference in its entirety. In particular, the foam panels may be pre-cut during manufacture using high precision CNC equipment, so as to be planar on their faces, and with very high accuracy in any given cuts (e.g., within 0.001 inch). This differs from what is possible with spray-in type foam materials, or the like. While the Applicant's foam panels may be preferred, any other foam panel construction may also be used. In an embodiment, no wood would be present in the wall or floor construction. For example, the foam panels may be solid foam, without channels, or if splines are desired (e.g., as described in Applicant's references, already incorporated by reference), metal splines could be used. An embodiment including metal splines to which the foam panels can be attached is described herein in conjunction with FIGS. 2A-3.

The containment structure may further include a granular material (e.g., gravel, crushed stone, or the like) for reducing hydraulic pressure against an exterior face of the foam wall. The granular material is positioned on the exterior surface of the foam wall (i.e., on the outside thereof, against the wall), so as to be between the foam wall and soil (i.e., dirt) that defines the grade. An interior face of the foam wall is further coated with a polymeric coating, plaster, cement, or another desired surface finish. In an embodiment, the coating may be elastomeric, abrasion resistant, and/or impact resistant. In an embodiment, the coating seals a below grade interior space defined between the floor and the wall in a seamless watertight configuration.

II. Exemplary Fluid Containment Structures

FIG. 1 illustrates an exemplary below grade fluid containment structure 100, such as an "in-ground" swimming pool. It will be appreciated that the cross-sectional width of the pool is shown in FIG. 1, with the length of the pool not shown, as it extends in and out of the page. It will also be appreciated that the system seen in FIG. 1 may also be used to construct other below grade "in-ground" structures, such as septic tanks, biodigesters, or other similar structures that are below grade, meaning below ground level. The top of such a structure may be open, as in a typical outdoor pool, or may be covered, as desired. The top of the containment structure 100 may be approximately flush with "ground level" (e.g., within a foot thereof), or lower. Typically, the top of such containment structures will not extend above ground level, although if a roof covering structure were provided, the roof may be above ground level.

The fluid containment structure 100 differs from traditional construction methods for such structures, as it uses foam to form the walls 102 and floor 104. Preferably, both floor 104 and walls 102 are formed of foam, although conceivably one or the other could be concrete (e.g., a concrete floor) or some other material. That said, there are significant advantages to having the full walls and floor which are positioned below grade, formed of foam, rather than cementitious materials.

The illustrated construction significantly reduces construction time, as it is far easier to excavate the pool or other containment structure below grade, and then position foam panels to provide the floor 104 and walls 102, as opposed to the typical steps used to form a concrete pool construction. As shown, a granular material 106 is provided between the edges (i.e., border) of the excavated soil 108 and the foam panels that are placed in position as floor 104 or walls 102. This granular material 106 serves to reduce hydraulic pressure that would otherwise be applied by the soil, if the soil 108 were allowed to bear directly up against the exterior of the foam walls 102 and floor 104. Such granular material 106 allows water seeping into this region to be quickly carried away through the granular material 106. For example, water drains better through this granular material 106 as compared to the soil 108, particularly where the soil 108 includes a significant clay component. As shown in FIG. 1, one or more French drains 110 or similar drainage may be provided below the floor 104, e.g., in or at the bottom of the granular material layer 106, to carry away such water drainage. Such a configuration reduces hydraulic pressure against the floor 104, and particularly the walls 102, exerted by the soil 108 that defines the "ground level" grade G below which the structure 100 is positioned. The specific construction of French drains 110 and other similar suitable drainage systems will be familiar to those of skill in the art.

The granular material 106 may be gravel, crushed stone, or the like, e.g., typically having an average particle size of less than 3 inches, less than 2 inches, less than 1 inch, or less than 0.5 inch. The average particle size of the granular material may be greater than 1 mm, greater than 2 mm, or greater than 3 mm, e.g., more coarse than sand, although in some embodiments, sand could be used, if desired.

The foam floor 104 and foam walls 102 may typically have a thickness of at least 4 inches, such as 4 inches to 24 inches, 4 inches to 16 inches, or 6 inches to 12 inches (e.g., 9 inches).

Whatever thickness foam is used, the foam panels provide significant insulative characteristics. For example, for expanded polystyrene foam, each inch of foam thickness provides an R value of about 4. For example, 9 inch thick panels would provide an R value of about 36. Such insulation insulates the contents of the fluid containment structure (e.g., pool water, septic tank, biodigester, etc.) 100 from ground temperatures, particularly fluctuations in ground temperature. Perhaps even more importantly, the insulation characteristics of the foam insulate the contents of the structure from the "heat sink" characteristics of the surrounding ground. For example, if a pool is heated, the pool water is heated to a temperature that is greater than the typical ground temperature, and as a result the ground acts as a heat sink, constantly pulling heat away from the pool water, through the pool wall 102 (and floor 104), into the ground (effectively heating the ground with the heated pool water). By using a foam floor 104 and foam wall 102, loss of heat through the wall 102 and/or floor 104 is greatly reduced, which greatly reduces energy costs to maintain the pool at a desired temperature. Similar considerations apply to a biodigester (e.g., where it may be important to maintain the contents of the digester at a given temperature to promote growth and health of the bioculture grown in the biodigester). Similar considerations may apply to a septic tank or other below grade fluid containment structure (e.g., to prevent freezing, etc.).

In the case of a pool or any other structure, such insulation will greatly reduce heating costs as the surrounding soil in a traditional pool acts as a heat sink, drawing heat out of heated pool water or other structure contents. In other words, it is expensive to heat pool water, as the heat is continuously being drawn out of the pool, into the surrounding soil. The foam walls 102 and floor 104 greatly reduce this loss of heat to the soil 108. Whether in the context of a pool, biodigester or other fluid containment, the fluid in the structure can be maintained at a desired temperature more economically.

The foam underground structure is constructed (e.g., foam panels are placed as floor and walls) and then the interior surface of the foam panels of the floor and walls are sprayed or otherwise coated with a coating 112 (e.g., a polymeric coating). In an embodiment, this coating 112 provides waterproof characteristics in a manner that coats over any seams (e.g., seams 114) between foam panels of the floor and/or walls, and any foam gussets 116 such as those shown at the bottom edge of the pool or other structure, where the floor 104 and wall 102 intersect. In an embodiment, plaster, cement, or another desired coating could alternatively be used.

The foam gussets 116 shown at the bottom of the pool structure, spanning the edge or corner between the floor 104 and wall 102 ensures that no 90° or other angled surface is present at these locations, but instead provides the desired concavely curved interior transition which makes cleaning of the interior of the pool or other containment structure simple. Perhaps more importantly, this internal gusset 116 also provides additional reinforcement to support the soil load that is applied against the lower portion of the vertical wall 102, below that section of the soil and granular material at the angle of repose (at 118). Such a gusset 116 aids in transferring the applied soil load to the floor 104.

The sprayed or otherwise applied coating 112 may provide sufficient impact resistance and rigidity to the foam panels of the floor 104 and wall(s) 102 to resist impacts that may be expected during normal use and operation of such a pool or other structure 100. By way of example, the coating thickness may be greater than 5 mils, and up to 500 mils, although typically no more than 150 mils would be needed (e.g., 6 mils to 150 mils, or 6 mils to 30 mils). Cement or plaster coatings may be of a thickness typically employed in concrete pool construction.

Examples of polymeric coatings include curable polyurethanes and curable polyureas. Such coatings also exhibit some degree of elasticity, which is sufficient that the coating does not crack or otherwise fail over years of use, even when exposed to daily and seasonal temperature, humidity, and other environmental changes. Such a coating may be similar to a truck-bed liner material. The coating water-proofs the interior of the pool or other containment structure 100. The coating may also exhibit non-stick properties, such that dirt, soil, or other materials are easily removed therefrom, e.g., above the water-line, or if drained. Where the pool, digester or septic tank is drained, such coating 112 could be easily cleaned by pressure washing, as desired.

Because of the applied one-piece coating 112, there are no seams or joints that are exposed in the coated boundary of the wall(s) 102, and floor 104 (all of which may be collectively coated with a single piece coating 112). This coating seal allows the interior volume defined by the floor 104 and wall(s) 102 to hold a desired liquid without risk of leaks.

The foam panels used for the floor 104 and wall(s) 102 are typically provided precut, as rigid foam sheet panels, exhibiting near perfect planar characteristics, rather than a spray-in type foam. Such foam panels are described in Applicant's earlier applications, incorporated by reference herein. The rigid, pre-cut, planar characteristics of the foam panels of the walls 102 and floor 104 ensure that the foam panels are flat, which aids in creating a smooth, flat interior surface for the pool or other containment structure 100, after application of the polymeric coating 112.

For example, as described in Applicant's applications already incorporated by reference, such foam panels can typically be cut to an accuracy of 0.001 inch (i.e., 1 mil). Thus, the planar surface may have low surface roughness (e.g., less than 0.1 inch, or no more than 0.001 inch variability in the "normal" direction relative to the plane).

Even though the final coating 112 is applied e.g., by spraying, this surface is relatively thin, and is able to maintain the substantially planar characteristics of the underlying foam, even as the coating is sprayed over, e.g., in a similar manner as a coating of paint.

The floor 104 may be constructed of floor foam panels, similar to those of the walls 102. In another embodiment, a concrete or other floor formed from a material other than foam could conceivably be provided, with foam walls 102 being attached thereto. In any case, the interface between the wall(s) 102 and the floor 104 is sealed with the polyurethane or other coating 112, which ties the two structures together into a single piece structure. The exterior surface of the foam may also be coated, e.g., before placement of the granular material 106, and/or placement of the coated foam structure into the excavation. For example, in one embodiment, the foam floor 104 and wall(s) 102 could be pre-constructed, e.g., either inside or outside of the excavation, including coating one or both faces of the foam assembly with the polymeric coating 112. If assembled outside of the excavation, the pre-constructed foam assembly can be lowered down into the excavation at some point during construction. For example, in an embodiment, the portion of the granular material layer 106 (e.g., gravel layer) that is below the floor 104 may be laid in the excavated hole, followed by placement or assembly of the floor 104 thereover. Individual foam panels for the floor 104 and walls 102, gussets 116, and buttresses 120 may be attached to one another using an adhesive suitable for such purpose, e.g., as disclosed in Applicant's earlier filed applications. With individual foam panels adhered to one another, the assembly of foam panels can then be oversprayed with the polymeric coating 112. The coating 112 can be tinted to any color or other types of coatings can be applied to add UV stability, color, etc.

At least a portion of the exterior of the foam assembly may be coated with the coating 112, as well as the entire interior of the foam assembly. For example, at least the lower portion of the exterior of the foam assembly, below the foam buttress 120 on the outside of the upper portion of the wall 102. Of course, even this upper portion may also be coated, if desired.

With the foam floor and foam wall(s) in place, the vertically oriented portions of the granular material 106 may be backfilled, e.g., by pouring gravel or other well-draining granular material 106 into the space between the soil boundary defined by the excavation and the foam material. As shown in FIG. 1, an upper portion 118*a* of the vertically oriented portion of the granular material layer 106 may be diagonally angled, e.g., at, close to, or more shallow in angle than the applicable angle of repose of the soil material that the excavation is formed in. For example, for typical soils, the angle of repose (i.e., that angle or incline that the soil can maintain without falling) may be from 30° to 45°. As illustrated, the upper portion of the wall(s) 102 may further include a foam buttress 120 as shown that is attached to the vertical portion of the foam wall 102, on the exterior face of the foam wall 102, e.g., flush or nearly flush with the top of the wall 102. The foam buttress 120 may be triangular in shape, as shown. The underside of the buttress 120 may be cut to the desired angle of repose 118*a*, e.g., so as to aid the upper portion of the granular material 106 and the soil 108 to assume this same angle of repose (at 118*a*, and 118*b*, respectively). As noted above, this greatly reduces any load applied by the soil 108 to this portion of the foam assembly.

Where the angle is set at 45°, this will result in the soil along the upper half of the excavation being positioned at the angle of repose, such that this portion of the excavation applies substantially no load to the upper half of the wall of the containment structure 100. In other words, there may be substantially no inward soil load on the triangular foam buttress 120, or on the adjacent upper portion (102*a*) of the vertical wall 102. Thus, the only load applied on the vertical wall 102 may be due to that portion of soil 108 (and granular material backfill 106) on the lower half (102*b*) of the vertical wall 102. Because of the inclusion of the angled buttress 120 which removes much of the soil load that would otherwise be present, no structural steel, concrete, or other materials stronger than the foam are needed.

Where the interior and at least a portion of the exterior faces of the foam assembly of the floor 104 and wall(s) 102 are coated with the polymeric coating material, the entire foam assembly becomes a monocot structure, acting as a monocot, integral single structure, rather than an assembly of separate wall and floor panels (which can be separated and break apart at their attachment points).

The system and method advantageously does not require any heavy equipment for construction. For example, no cranes, no cement trucks, no cement or concrete, no cutting of steel rebar, no concrete spraying (shotcrete) equipment or the like are needed. For example, the present system and method may reduce cost and/or time to fabricate an in-ground pool or other below grade containment structure by about ⅔, which is very significant.

Each of applicant's U.S. patent application Ser. Nos. 13/866,569, 13/436,403; 15/426,756, 62/890,818, Ser. No. 16/709,674 (now U.S. Pat. No. 10,865,560, 16/824,209, 62/991,889, Ser. No. 16/942,166, PCT/US20/59989, 29/744, 477, and Ser. No. 16/549,901 and Applicant's U.S. Pat. Nos. 10,450,736 and D861,194, is each incorporated by reference in its entirety. For example, the panels may include a body, with a plurality of channels extending through a length or width of the panel, each channel being configured to receive a spline therein, wherein each spline once received in the channel is disposed within the body, without the spline being exposed on an outside face of the body, so that the spline is restrained once received within the channel. The body may be formed from foam, and the foam body may be generally rectangular in shape.

If desired, cementitious panels such as those described in Applicant's U.S. patent application Ser. No. 15/426,756 and 62/722,591 or Ser. No. 16/549,901 could be applied over the interior or exterior faces of the foam panels of the wall 102 or floor 104. Such panels can provide improved impact resistance, as compared to the underlying foam wall panels, should such be desired.

Figure 2A:
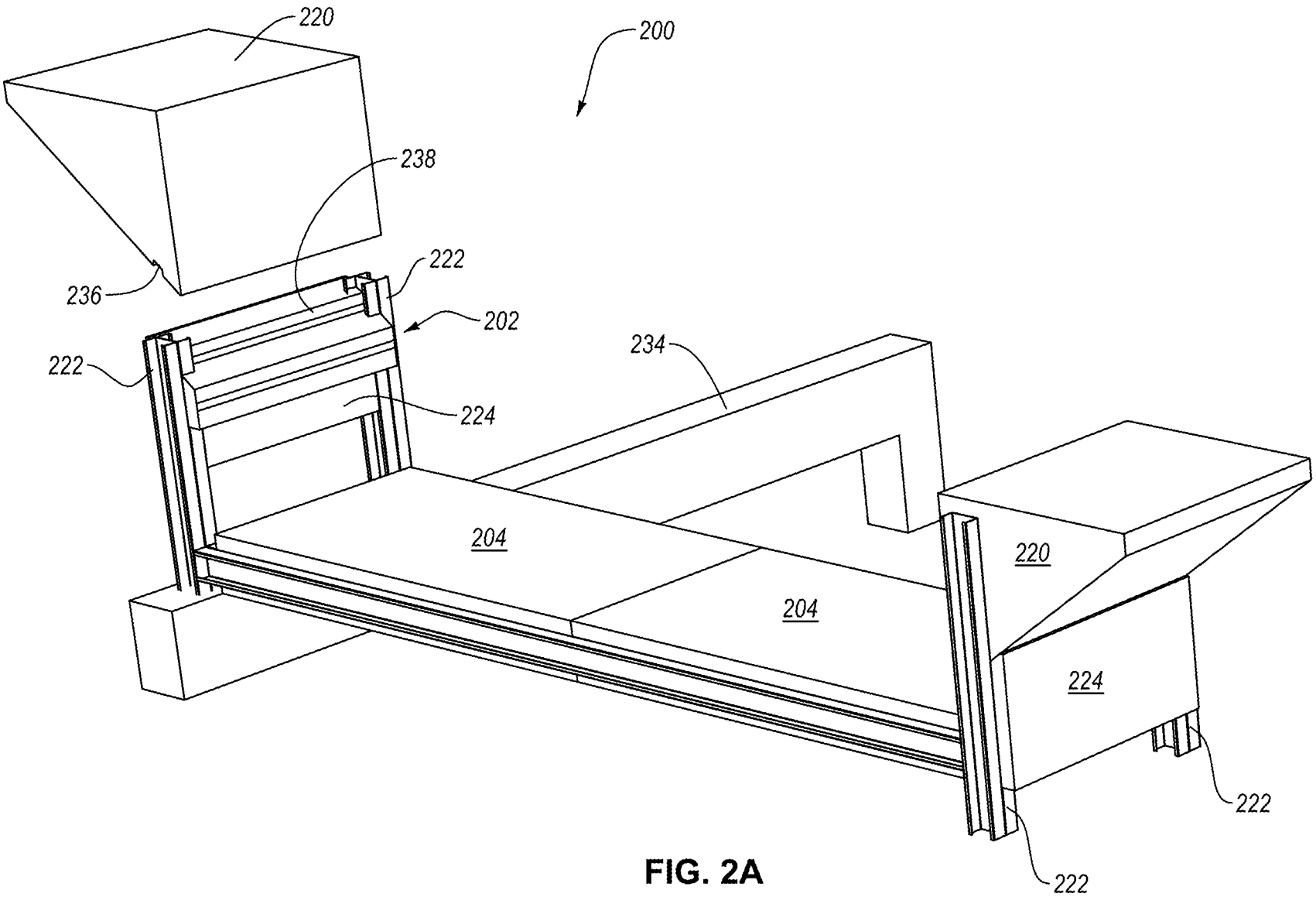
FIGS. 2A-2B illustrate perspective view, including a close up perspective view in FIG. 2B, of another exemplary construction scheme for a below grade fluid containment structure according to the present invention.
Figure 2B:
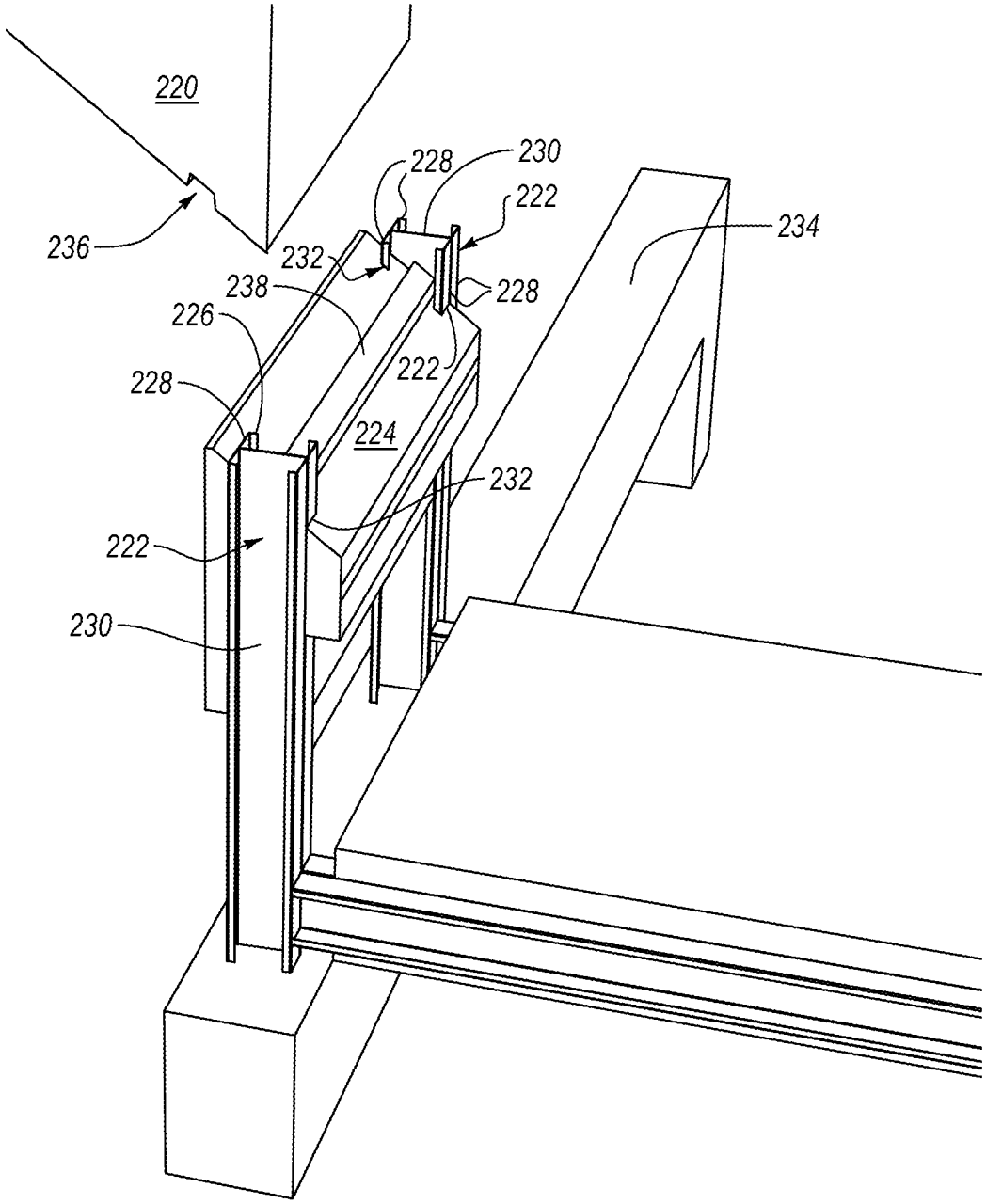
Figure 3:
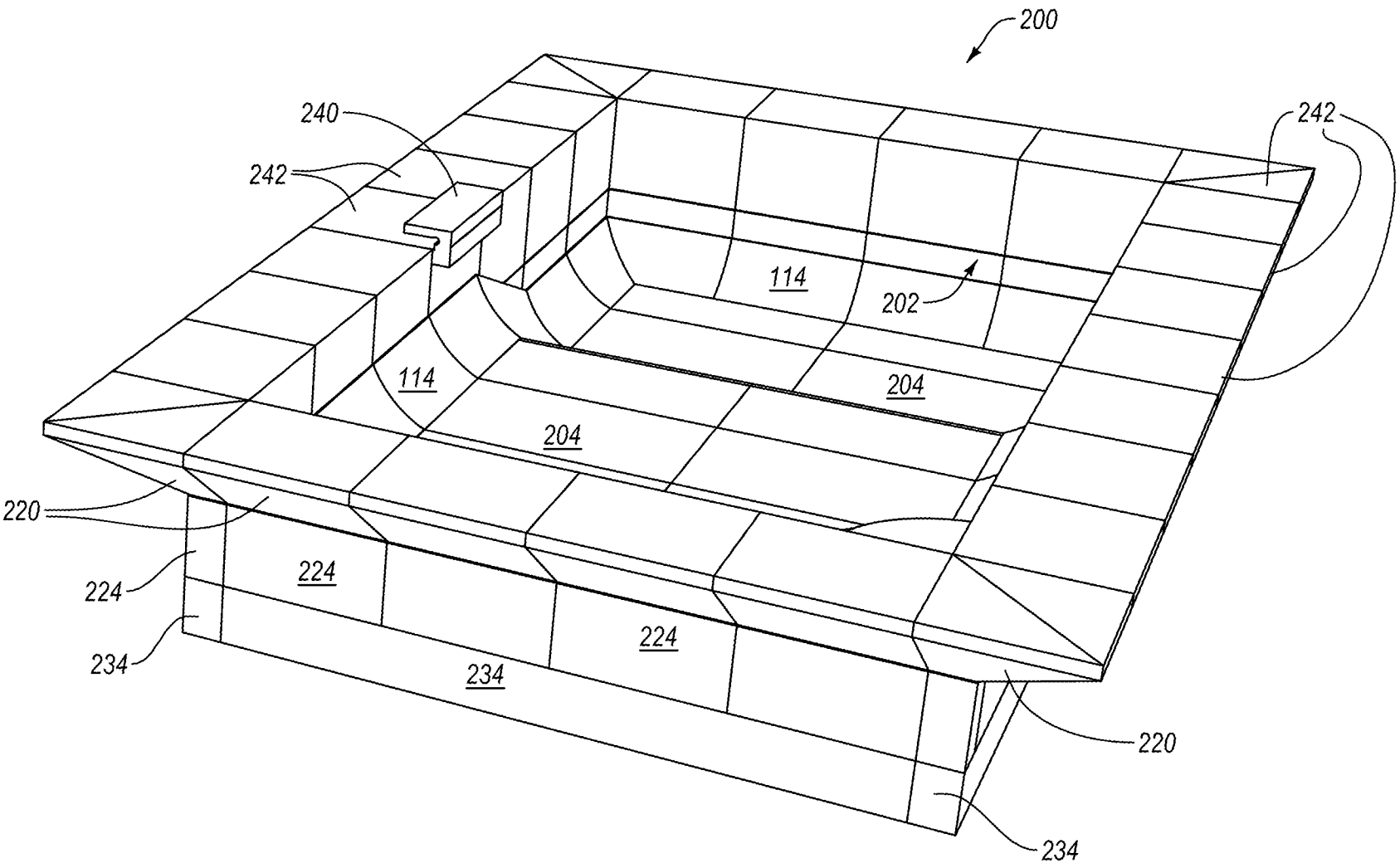
FIG. 3 illustrates a perspective view of a swimming pool constructed using the construction scheme shown in FIGS. 2A-2B.

FIGS. 2A-3 illustrate another embodiment by which a pool or other below ground fluid containment structure 200 could be fabricated. For example, FIG. 2A schematically illustrates how a portion of such a pool or similar structure 200 can be constructed, from foam panels for forming the walls 202 and floor 204, with metal splines 222 providing a structural frame, for aiding in supporting the foam panels, and providing overall strength to the finished structure. As described previously, floor 204 may rest on pea gravel or similar granular material of a level prepared ground surface.

As shown in FIGS. 2A and 2B, a floor can be formed from foam panels 204. As shown in FIG. 2A, such panels may be generally rectangular in shape, with a pair of channels extending horizontally along the length of such panels, with the channels formed into the right and left sides of such panels. An I beam-spline 222 may be secured to such floor panels, by inserting the flanges on one side of such I beam into the corresponding channels of each panel 204. While FIG. 2A only shows a single row of such floor panels, it will be appreciated that the structure shown can simply be repeated, with another row of floor panels 204 positioned on one or both sides of the illustrated row, to achieve the desired pool length or width. As shown in FIG. 2A, one side of the flanges on the I-beam spline are not engaged, and could be inserted into the channels of another row of panels, if desired, to create the desired structure (e.g., see FIG. 3).

The foam wall in FIG. 2A can be formed by similarly providing foam panels 224, including channels formed therein, with the panels 224 slid between the spline members 222. The I beam spline members may be formed by positioning two generally C-shaped channels back-to-back, as illustrated. A lip 226 may be provided on the ends of each flange 228, as best seen in FIG. 2B, if desired. Each spline may thus be generally configured as an I-beam, including a central web 230 and flanges 228. Each side of the I-beam (one of the C-channel members really) may be used to connect the spline 222 to each foam panel. Of course at a corner, where no further foam panel may be needed, the C-channel members need not be assembled back-to-back.

The inclusion of the return lip 226 on the ends of each flange 228 ensures that the foam panel cannot pull out laterally from the flange of the vertical wall splines. Rather, because of the presence of the return lip 226, the foam wall panels cannot be slid into the flange laterally from the side, but must be slid down from the top, because the channel cut into each foam wall panel 224 coincides with the profile of the flange 228, including the return lip 226. Thus, the two structures can only be mated to one another by sliding one down into the other. This configuration prevents lateral pull-out, as noted, ensuring that the mated relationship between the spline and the foam panel is exact, keeping the spline and foam panel both vertical, parallel to one another, without any gaps in the channel, during such insertion or mating.

While the horizontal splines used in forming the foam floor may similarly include the return lip 226 on each flange 228, the channels of the foam floor panels 204 may be cut wider, to accommodate lateral insertion of the two mating structure to one another. While this could allow lateral pull out between the horizontal floor splines and the floor panels, the possibility of such is of less concern, as the floor splines simply serve to maintain the vertical wall splines at equal spacing (e.g., 3 feet, or 4 feet), as well as to set the elevation of the vertical spline members of the wall.

As seen in FIGS. 2A-2B, wall 204 is formed from a system of modular foam panels 224 positioned between pairs of splines 222. Each panel 224 includes a foam body and a pair of channels 232 formed therein (e.g., running vertically, along the left and right edges of the panel 224). Such channels are configured to receive flanges 228 and lips 226 of the splines 222. For example, the panels 224 may simply slide from the top, into such a frame formed from the splines 222. Once the panel is slid into the space between adjacent splines, the flanges 228 are restrained within the channel 232 of the corresponding panel, and the panel also being held in place, by the flanges. Because the bottom ends of the splines are eventually anchored into concrete footing 234, the entire wall is strongly anchored in place. In practice, the splines and foam panels may actually be installed/assembled first, with the splines extending into a footing trench. Once the splines and panels are installed, the concrete footing can be cast by filling the footing trench with concrete, tying all the splines together. The footing provides overturn resistance to soil and water pressures. This is an advantage, as compared to a method by which the footing is poured early in the process, as if the footing is poured early in the process, the vertical splines must be positioned perfectly straight in the footing. In the contemplated method, where the footing is actually not poured until near the end of the process, the vertical splines do not initially need to be perfectly straight, as they will be straightened once the foam wall panels are inserted between pairs of splines, forcing them to then be perfectly vertical, as the foam panels are precision shaped to ensure such, when the flanges of the splines are engaged within the channels of the foam panels.

Figure 4:
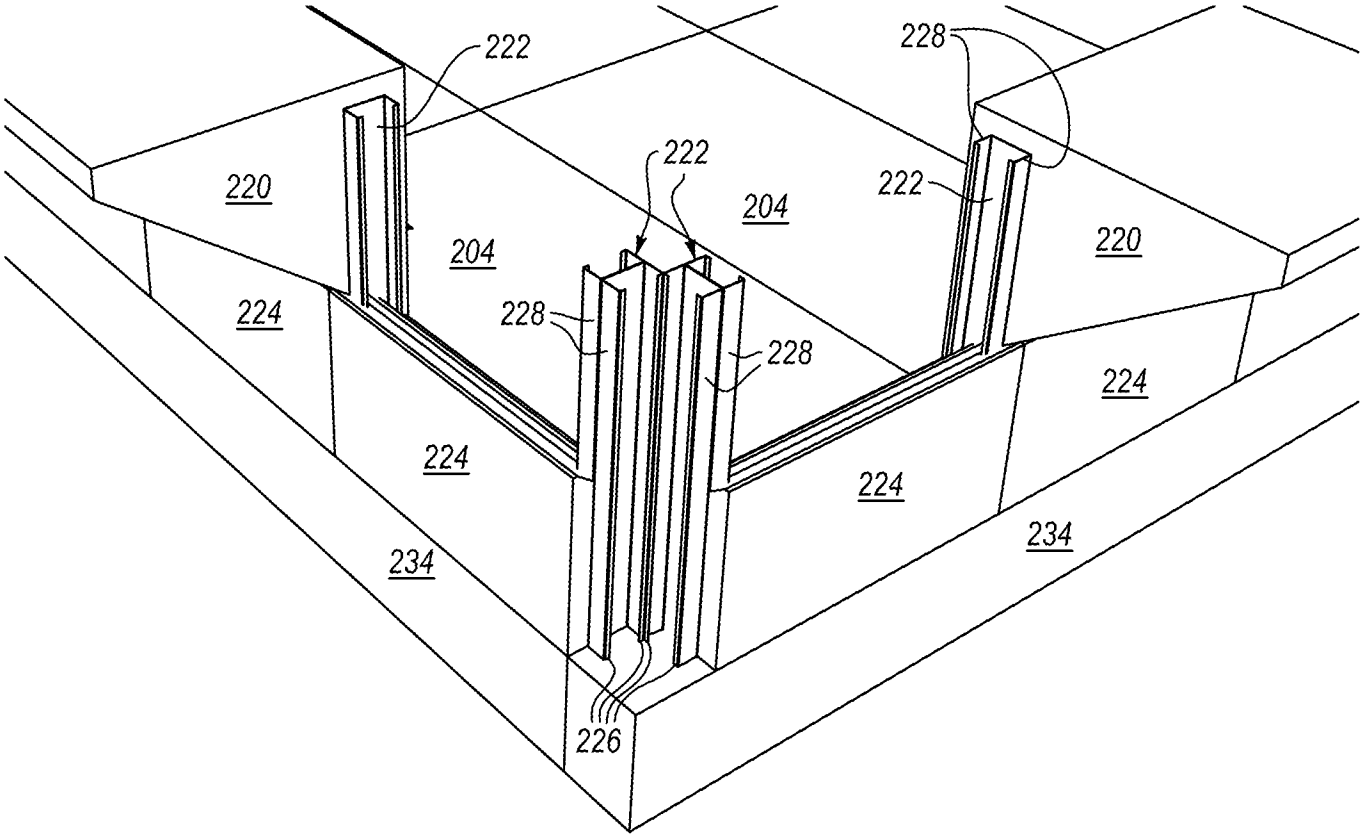
FIG. 4 illustrates a partial cut-away view showing a corner of the swimming pool of FIG. 3, with some of the foam panels along the top removed to better illustrate internal structure.

While FIGS. 2A and 2B simply show one modular row of a wall section and a floor section, it will be appreciated that this modular structure can be repeated for whatever length of pool or other structure is desired. By way of further example, typical spacing between spline elements of the overall frame may be 3 feet, 4 feet, or the like. To construct the end walls of the pool, the pieces are simply rotated 90° to form the desired end walls, as will be apparent from FIGS. 3-4. As is apparent from FIG. 4, in the end wall corners, vertical splines can be used, in a kitty-corner arrangement (with one of the C-shaped splines 222 facing towards the end of one wall of the corner, and another C-shaped spline 222 of another spline facing towards the end of the other wall of the corner, so as to be touching or adjacent to one another, but oriented 90° from one another, in-line with their respective walls meeting at the corner. The flanges 228 of each of such C-shaped spline members can be received into corresponding channels of a 45° cut foam panel, as apparent from FIGS. 3-4, which panels can be glued or otherwise attached together, forming the appearance of a "45° mitered" corner, as shown in FIG. 3.

FIGS. 2A and 2B illustrate use of the foam buttress 220 which can slide into the frame formed from the splines 222, over the top of the wall panels 224, between splines 222. As shown, an underside of the foam buttress 220 may include a keyed structure (e.g., a recess 236) for mating with a corresponding keyed structure (e.g., protrusion 238). Any suitable adhesive may be used to attach the various foam pieces together, in addition or alternative to the presence of channels that may be present in foam buttress 220, to also secure foam buttress 220 to the flanges 228 (and lips 226) of splines 222.

As described above, the interior face of the foam wall 202 and the foam floor 204 can be coated with cement, plaster, a polymeric coating, or any other coating (including a vinyl or other liner) as desired to provide a finished interior surface for the pool or other structure 200. Gussets 116 and other features as described previously can of course be integrated into such a pool construction.

FIG. 3 shows a completed foam structure for a pool 200. As described relative to the previous embodiments, such a pool structure becomes insulated, because it is constructed of foam (i.e., the walls and floors, providing a thermal break between the pool contents and the underlying or adjacent soil). Such insulated characteristics provide a significant benefit over other concrete pool constructions, which do not provide any significant insulation characteristics relative to the ground, which acts as a heat sink, pulling heat out of the water in the pool. The present pool system can easily and inexpensively be heated, even in winter climates, to provide year round outside swimming, at reasonable cost (e.g., perhaps 10% or less the typical cost of trying to heat a concrete pool). In addition, the pool can be drained without damage like a concrete pool, unlike a fiberglass drop in pool.

Because the foam panels act as the template, square, and measuring tool in constructing the pool, no tape measure or similar measuring device is actually needed to construct such a pool. As shown in FIG. 3, the pool deck 242 can be poured direction on top of the foam buttress member 220, eliminating any need for compaction of soil around the pool, as the top diagonal foam buttress member 220 actually provides support to the pool deck, which can be formed (e.g., poured concrete) over the top surface of such buttress member 220.

The illustrated pool configuration further allows for backfilling of soil or granular material prior to filling the pool with water. Such is not possible with various other types of pools (e.g., a drop in fiberglass pool).

As described, the foam walls and floor serve as a good material to bond a cementitious plaster finish coating material to. Alternatively, the foam could also be sprayed with a polyuria or similar polymeric coating, as desired. A pool liner (e.g., vinyl) could also be used.

The particular construction method allows construction of pools of any desired dimensions, without limitation, unlike the limitations that occur with fiberglass drop-in in-ground pools. In addition, the speed of construction is far faster than is typical of concrete pools (e.g., the entire process is easily completed by a small crew of 2-3 people within 1-2 weeks), rather than a process that takes months in the case of a concrete pool, or several weeks in the case of a fiberglass pool. The process results in very little if any construction waste, and any waste foam can simply be recycled.

Finally, as shown in FIG. 3, a coping form 240 can be provided, integral with or otherwise attached to the foam panels forming the wall 202 and/or the buttress supporting the deck 242. Such a coping form 240 can be attached to the buttress member 220, to provide a rounded bull-nose or other desired finish coping formed integrally with the concrete pour used to form the pool deck 242. This coping form is easily removed (as it is foam that can simply be cut away) once the coping and deck 242 have sufficiently cured, leaving a desired finished coping around the pool. Alternatively, pavers or a precast coping could be used, as in a typical concrete pool.

It will be apparent that the overall method associated with constructing a pool or other below-ground fluid containment structure as described herein may therefore include steps of:

(a) excavating a hole in the ground for the pool or other below grade fluid containment structure;

(b) leveling a pea gravel or other granular material in the bottom of the excavated hole on which a foam floor will be fabricated;

(c) excavating a trench for a footing around a perimeter of the excavated hole (e.g., foam forms could be used to prevent collapse of such trench, and/or the walls of the excavated pool hole as a whole, if desired);

(d) positioning one or more foam floor panels of the foam floor on the leveled pea gravel or other granular material;

(e) positioning flanges of a horizontal metal spline of the foam floor into corresponding channels of the foam floor panel to form the foam floor on the leveled pea gravel or other granular material;

(f) connecting a vertical metal spline of the foam wall to the horizontal metal spline of the foam floor (e.g., using screws, bolts, welding, ears, etc. as desired), a bottom of the vertical metal spline extending into the trench for the footing below the foam floor;

(g) sliding a foam wall panel of the foam wall so that flanges of the vertical metal spline are received within corresponding channels of the foam wall panel, wherein the foam wall panel ensures that the vertical metal spline attains a truly vertical orientation and remains there; and repeating one or more of steps (d)-(g) to complete fabrication of the foam floor and foam walls for the pool or other below grade fluid containment structure.

Foam buttress panels as described herein may be used in forming the foam walls, where the laterally extending buttress portion is integral with, or separate from and attached to the foam panels used to form the walls. The use of such foam buttress panels as described herein is one key advantage of the present invention, as the laterally extending (e.g., generally triangular cross-section) buttress structure reduces or eliminates soil load pressures on the pool or other fluid containment structure wall, at least along the top portion of the wall (depending on how deep the buttress structure extends). The depth and lateral extension of the generally triangular laterally extending buttress structure can be determined based on the depth of the pool or other fluid containment structure, and the engineering criteria for the associated wall. By way of example, for a 6 foot, 8 foot, 9 foot, 10 foot, or 12 foot pool, appropriate buttress dimensions can be determined and an appropriate buttress provided. By way of example, the buttress may have a height that may be from about 35% to about 70%, or 40% to about 60% of the overall depth of the pool or other fluid containment structure. For example, a 3-foot buttress height may be appropriate for a 6 or 7 foot depth pool, a 4 or 5-foot buttress height may be appropriate for an 8 or 9 foot depth pool, etc. As described herein, the buttress also advantageously eliminates any need to compact the soil under a pool deck area, as the top of the buttress provides a surface on which a concrete or other pool deck can easily be formed, which will not settle. The foam buttress also provides insulation to the pool deck.

Once fabrication of the foam floor and foam walls for the pool or other below grade fluid containment structure have been completed, the trench for the footing can be filled with concrete, to anchor the bottom ends of the vertical splines in place. Because the splines and their interposed foam wall panels are assembled before the footing is poured, and because the precision cut characteristics of the foam panels (aided by the presence of a return lip 226 on flange 228 as described) force the wall splines to assume a perfectly vertical orientation, there is no need to otherwise ensure, measure or verify that the vertical splines are in fact vertical. In other words, the precision cut foam panels, and the mechanism by which they mate with the vertical splines ensures that the vertical splines are in fact vertical, as well as the resulting formed pool wall.

While the present structure and methods are described in the context of using metal splines interposed between the foam panels forming the foam floor and foam walls, in order to provide increased structural strength for a larger pool or other below ground fluid containment structure, it will be appreciated that is small pools or similar containment structures, no such splines forming a frame structure may be needed at all. For example, for a depth of about 3 feet or less, foam panels could simply be used, particularly where the foam buttress panels as described herein are used, which eliminate or largely reduce the presence of any hydraulic pressures that may otherwise be exerted on the walls of the pool or similar fluid containment structure. As such, for smaller structures, the described vertical and/or horizontal splines making up the frame may be omitted.

While the illustrated structures are shown principally in the context of construction of an in-ground swimming pool, it will be appreciated that they are equally applicable to other below ground fluid containment structures.

It will also be appreciated that the present claimed invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

The invention claimed is:

1. A pool or other below grade fluid containment structure comprising:

a foam floor;

a foam wall extending upward from the floor, the foam wall being formed from a system of modular foam panels;

a foam buttress positioned adjacent a top of the foam wall, extending laterally outward from the foam wall, the foam buttress being shaped to reduce soil load by putting soil at no more than an angle that approximates an angle of repose for the soil;

wherein an interior face of the foam wall and the foam floor are coated with a cement, plaster, or other coating to provide a finished interior surface for the pool or other below grade fluid containment structure.

2. A pool or other below grade fluid containment structure as recited in claim 1, wherein the pool or other below grade fluid containment structure comprises:

the foam floor;

the foam wall extending upward from the floor, the foam wall being formed from a system of modular foam panels interspaced between a plurality of wall splines, wherein the modular foam panels comprise:

a foam body; and a plurality of channels extending along a length or width of the panel, each channel being configured to receive at least a portion of a spline therein, wherein each spline portion once received in the channel is disposed within the body, so that the spline is restrained once received within the channel; and a concrete footing positioned below the foam wall, wherein the wall splines are vertically oriented in the foam wall, with a bottom of the wall splines being anchored into the concrete footing.

3. A pool or other below grade fluid containment structure as recited in claim 1, wherein a pool deck is provided on a top surface of the foam buttress, no compaction of soil underlying the pool deck being required to ensure it does not settle.

4. A pool or other below grade fluid containment structure as recited in claim 1, wherein the foam buttress is shaped to provide an angle for the soil of from 30° to 45°.

5. A pool or other below grade fluid containment structure as recited in claim 2, wherein the wall splines include a flange with a return lip at an end of the flange, where the channels formed into the foam panels of the foam wall are shaped to correspond to the flange with the return lip of the wall splines, for receipt of the flange and return lip into a corresponding channel of the foam panels.

6. A pool or other below grade fluid containment structure as recited in claim 1, further comprising gravel, crushed stone, or another granular material positioned under the foam floor and/or between the foam wall and soil on an exterior of the foam wall.

7. A pool or other below grade fluid containment structure as recited in claim 1, further comprising a foam gusset positioned in a corner defined between the floor and the wall.

8. A pool or other below grade fluid containment structure as recited in claim 1, wherein other than the concrete footing and any plaster or cement coating on the interior surfaces of the foam wall or foam floor, the structure does not include any shotcrete or other concrete.

9. A pool or other below grade fluid containment structure as recited in claim 8, wherein the floor and wall do not include any rebar reinforcement.

10. A pool or other below grade fluid containment structure as recited in claim 1, further comprising a french drain below the foam floor.

11. A pool or other below grade fluid containment structure as recited in claim 2, wherein the walls are constructed using a plurality of foam panels, each panel being positioned between a pair of vertical wall splines, the wall splines providing a generally I-beam shaped configuration, where flanges of the I-beam are received into the channels of the foam panel between such wall splines.

12. A pool or other below grade fluid containment structure as recited in claim 11, wherein the splines are formed from 2 generally C-shaped members, positioned back-to-back, to form the generally I-beam shaped configuration, wherein each C-shaped member includes a return lip at an end of each flange.

13. A pool or other below grade fluid containment structure as recited in claim 1, wherein the foam floor and foam wall are constructed from rigid foam panels of about 1 lb/ft$^3$ or greater density foam.

14. A pool or other below grade fluid containment structure as recited in claim 1, wherein the foam floor and foam wall provide an insulated thermal break between the pool or other structure contents and exterior soil.

15. A pool or other below grade fluid containment structure comprising:

a foam floor;

a foam wall extending upward from the floor, the foam wall being formed from a system of modular foam panels with each panel positioned between a pair of metal splines on either side of the panel, wherein the modular foam panels comprise:

a foam body; and a pair of channels extending vertically along a height of the panel, each channel being configured to receive a flange of a spline therein, wherein each flange once received in the channel is disposed within the foam body, so that the spline is restrained once received within the channel;

a concrete footing positioned below the foam wall, wherein the splines are vertically oriented in the foam wall, with a bottom of the splines being anchored into the concrete footing;

wherein the foam wall includes a foam buttress positioned adjacent a top of the foam wall, extending laterally outward from the foam wall, the foam buttress being shaped to reduce soil load by putting soil at no more than an angle that approximates an angle of repose for the soil;

wherein an interior face of the foam wall and the foam floor are coated with a cement, plaster, or other coating to provide a finished interior surface for the pool or other below grade fluid containment structure.

16. A pool or other below grade fluid containment structure as recited in claim 15, wherein the walls are constructed using a plurality of foam panels, each panel being positioned between a pair of vertical spline members, the spline members providing a generally I-beam shaped configuration, where flanges of the I-beam are received into the channels of the foam panel between such spline members.

17. A pool or other below grade fluid containment structure as recited in claim 16, wherein the splines are formed from 2 generally C-shaped members, positioned back-to-back, to form the generally I-beam shaped configuration, wherein each C-shaped member includes a return lip at an end of each flange.

18. A pool or other below grade fluid containment structure as recited in claim 15, wherein a pool deck is provided on a top surface of the foam buttress, no compaction of soil underlying the pool deck being required to ensure it does not settle.

19. A pool or other below grade fluid containment structure as recited in claim 15, wherein the foam floor and foam wall provide an insulated thermal break between the pool or other structure contents and exterior soil.

20. A method for fabricating a pool or other below grade fluid containment structure having a foam floor and foam walls, the method comprising:

(a) excavating a hole in ground for the pool or other below grade fluid containment structure;

(b) leveling a pea gravel or other granular material in a bottom of the excavated hole;

(c) excavating a trench for a footing around a perimeter of the excavated hole;

(d) positioning one or more foam floor panels of the foam floor on the leveled pea gravel or other granular material;

(e) positioning a flange of a horizontal metal spline of the foam floor into a channel of the foam floor panel to form the foam floor on the leveled pea gravel or other granular material;

(f) connecting a vertical metal spline of the foam wall to the horizontal metal spline of the foam floor, a bottom of the vertical metal spline extending into the trench for the footing below the foam floor;

(g) sliding a foam wall panel of the foam wall so that flanges of the vertical metal spline are received within corresponding channels of the foam wall panel, wherein the foam wall panel ensures that the vertical metal spline is and remains vertical;

repeating one or more of steps (d)-(g) to complete fabrication of the foam floor and foam walls for the pool or other below grade fluid containment structure; and once fabrication of the foam floor and foam walls for the pool or other below grade fluid containment structure have been completed, filling the trench for the footing with concrete, to anchor the bottom ends of the vertical splines in place.

* * * * *